United States Patent [19]

Otsuka

[11] 4,334,515

[45] Jun. 15, 1982

[54] TEMPERATURE RESPONSIVE, PRESSURE OPERATED DIAPHRAGM VALVE ASSEMBLY FOR AUTOMOBILE ENGINE

[75] Inventor: Kazutoshi Otsuka, Hiroshima, Japan

[73] Assignee: Toyo Kogyo Co., Ltd., Hiroshima, Japan

[21] Appl. No.: 116,607

[22] Filed: Jan. 24, 1980

[30] Foreign Application Priority Data

Jan. 29, 1979 [JP] Japan ..... 54-10386[U]

[51] Int. Cl.[3] ..... F02M 25/06

[52] U.S. Cl. ..... 123/568; 123/588

[58] Field of Search ..... 123/585, 587, 588, 568

[56] References Cited

U.S. PATENT DOCUMENTS

| | | | |
|---|---|---|---|
| 3,802,402 | 4/1974 | Swatman | 123/568 |
| 3,990,418 | 11/1976 | Nohira et al. | 123/568 |
| 4,098,241 | 7/1978 | Tateno et al. | 123/588 |
| 4,117,814 | 10/1978 | Takahashi | 123/588 |
| 4,163,434 | 8/1979 | Tsukamoto et al. | 123/588 |
| 4,191,143 | 3/1980 | Ysuki | 123/568 X |

*Primary Examiner*—Wendell E. Burns

*Attorney, Agent, or Firm*—Wenderoth, Lind & Ponack

[57] ABSTRACT

A temperature responsive, pressure operated diaphragm valve assembly for use in association with an automobile internal combustion engine comprises a valve housing having a working chamber on one side of a diaphragm member, a biasing spring used to urge the diaphragm member in one direction with a valving element held in position to close a fluid passage, one end of the fluid passage being communicated to the fuel intake system of the engine and the other end thereof communicated to a source of fluid medium, and a temperature sensor having a parameter, the magnitude of which is variable according to the magnitude of the ambient temperature. The temperature sensor also has a push rod axially movable in response to change in magnitude of the parameter, the movement of the push rod being in turn transmitted to the biasing spring to adjust the biasing force exerted thereby on the diaphragm member. The fluid passage is opened only when the negative pressure introduced into the working chamber overcome the variable biasing force of the biasing spring determined by the engine reference temperature.

7 Claims, 7 Drawing Figures

TEMPERATURE RESPONSIVE, PRESSURE OPERATED DIAPHRAGM VALVE ASSEMBLY FOR AUTOMOBILE ENGINE

BACKGROUND OF THE INVENTION

The present invention relates to a temperature responsive, pressure operated diaphragm valve assembly for use in association with an automobile internal combustion engine.

As is well known to those skilled in the art, an automobile internal combustion engine employs some diaphragm valve assemblies. Because they are operated by the negative pressure developed in the fuel intake system of the engine, each of these conventional diaphragm valve assemblies is generally of a type comprising a valve housing, a diaphragm member defining at least one working chamber inside the valve housing and communicated to the fuel intake system for the introduction of a negative pressure into the working chamber, a valving element adapted to selectively close and open a passage and rigidly carried by the diaphragm member for displacement together with the diaphragm member, and a biasing spring for urging the diaphragm member in one direction for holding the valving element in either an open position or a closed position.

An example of an application of the conventional diaphragm valve assembly of the construction referred to above is an automobile evaporative emission control system for controlling the emission of fuel vapors, generated from one or both of the fuel tank and the carburetor float chamber, to the atmosphere. In this application, the conventional diaphragm valve assembly serves to allow the introduction of the fuel vapors into the fuel intake system only when the negative pressure developed inside the intake system increases to a value sufficient to overcome the biasing force of the biasing spring inside the working chamber. However, it is fairly well understood that the mere introduction of the fuel vapors into the fuel intake system with no regard paid to the engine operating condition and/or the temperature under which the engine is operated is undesirable. By way of example, if the fuel vapors are introduced into the fuel intake system when the engine reference temperature, either the temperature of the engine or that of a cooling water used to cool the engine, is higher than a predetermined temperature, the air-fuel mixture flowing through the fuel intake system towards one or more combustion chambers will undesirably be enriched to such an extent as to result in emission of a relatively large amount of noxious unburned components of the exhaust gases to the atmosphere.

Another application of the conventional diaphragm valve assembly is an exhaust gas recirculating system for recirculating some of the exhaust gases from the engine exhaust system into the fuel intake system, such as disclosed in the Japanese Utility Model Laid-open Publication No. 53-22920, laid open to public inspection on Feb. 25, 1978, which corresponds to the U.S. Pat. No. 4,090,482, patented on May 23, 1978. According to this Japanese Utility Model Laid-open publication or its counterpart U.S. patent, there is disclosed an exhaust gas recirculating apparatus comprising a vacuum operated EGR valve having a diaphragm which forms a vacuum control chamber on one side of the diaphragm, which chamber is fluid connected to a vacuum port formed in the fuel intake system for transmitting a vacuum signal to the chamber in order to operate the EGR valve for controlling the amount of exhaust gases to be recirculated. The apparatus disclosed therein is further provided with a temperature detecting valve adapted for introducing a limited amount of air through an orifice when the engine is operating under a warm-up condition during which the temperature of the engine is not yet sufficiently increased, so that the amount of the gases recirculated during such an engine operating condition is decreased to some extent.

The temperature detecting valve employed in the Japanese Utility Model Laid-open publication is of a type comprising a cylindrical casing having at one end a temperature sensor, a piston member and a biasing spring for biasing the piston member. The temperature sensor includes a thermally expandable wax material and a push rod adapted to be axially moved according to the expansion and contraction of the thermally expandable wax material, the movement of the push rod being transmitted to the piston member to move the latter against the biasing spring. Depending upon the position of the piston member, a communication passage between the orifice and the atmosphere is selectively opened and closed. This temperature detecting valve is an integral valve completely separate from each of the vacuum operated EGR valve and the pressure control valve for controlling the pressure in the recirculating passage to a constant value according to the magnitude of the negative pressure.

The use of the diaphragm valve assembly in the EGR system is also disclosed in the Japanese Utility Model Laid-open Publication No. 53-143921, laid open to public inspection on Nov. 3, 1978. According to this publication, there is employed a diaphragm valve assembly of a type comprising a valve housing having a diaphragm member cooperative with the valve housing to define a working chamber, a biasing spring urging the diaphragm member in one direction, and an elongated valving element having one end connected to the diaphragm member and the other end adapted to selectively close and open the exhaust gas recirculating passage. While the diaphragm member is normally biased by the spring to cause the valving element to close the recirculating passage, the diaphragm member is displaced in the other direction against the biasing spring when the negative pressure introduced into the working chamber overcomes the biasing force of the spring. In this arrangement, a signal transmitting passage extending between a portion of the fuel intake system in the proximity of the throttle valve and the working chamber of the diaphragm valve assembly has a temperature responsive control valve installed thereon. This temperature responsive control valve is so designed as to introduce a regulated amount of air into the signal transmitting passage to reduce the negative pressure flowing therethrough, according to a change in temperature of a cooling water or lubricating oil which takes place in correspondence with the progress of the warm-up of the automobile engine. In this arrangement, the diaphragm valve assembly and the temperature responsive control valve assembly are separate assemblies.

Both of the apparatuses disclosed respectively in the above mentioned Japanese Utility Model Laid-open publications involve the common disadvantage that, since the vacuum signal transmitting passage extending between the fuel intake system and the EGR valve is adapted to be communicated to the atmosphere when the temperature of the engine is relatively low, the negative pressure to be introduced into the working chamber of the EGR valve when the engine remains at a constant temperature tends to fluctuate according to the opening of the throttle valve.

SUMMARY OF THE INVENTION

Accordingly, the present invention has been made with a view to substantially eliminate the above described disadvantages and inconveniences inherent in the prior art vacuum operated diaphragm valve assemblies and has for its essential object to provide an improved vacuum operated diaphragm valve assembly, specifically a temperature responsive, pressure operated diaphragm valve assembly, effective to substantially accurately control the opening of a passage according to a combination of at least two parameters, one being the negative pressure developed inside the fuel intake system and the other being the engine reference temperature.

Another important object of the present invention is to provide a temperature responsive, pressure operated diaphragm valve assembly of the type referred to above, which does not require passages to connect the EGR valve to the fuel intake system via the temperature detecting valve as required in the prior art apparatuses.

A further object of the present invention is to provide a temperature responsive, pressure operated diaphragm valve assembly of the type referred to above, which can be manufactured in a relatively simple and compact size without unduly increasing the manufacturing cost thereof.

In order to accomplish these and other objects of the present invention, the present invention is characterized in that the diaphragm valve assembly includes a valve housing having a working chamber defined on one side of the diaphragm member, a biasing spring for biasing the diaphragm member in one direction and means operable in response to change in the engine reference temperature for adjusting the biasing force of the biasing spring according to change in engine reference temperature such as to determine the maximum value of the negative pressure necessary to be introduced into the working chamber for displacing the diaphragm member in such one direction.

In one preferred embodiment of the present invention, the adjusting means is comprised of a temperature sensor including a temperature sensing element having a parameter, the magnitude of said parameter being variable as a function of the engine reference temperature, and a push rod supported for axial movement between projected and retracted positions, the movement of the push rod according to the magnitude of the parameter being transmitted to a valving element carried by the diaphragm member.

The temperature sensing element may be either a thermally expandable wax material or a bimetallic plate.

BRIEF DESCRIPTION OF THE DRAWINGS

These and other objects and features of the present invention will become apparent from the following description of preferred embodiments thereof and with reference to the accompanying drawings, in which.

DETAILED DESCRIPTION OF THE INVENTION

Figure 1:
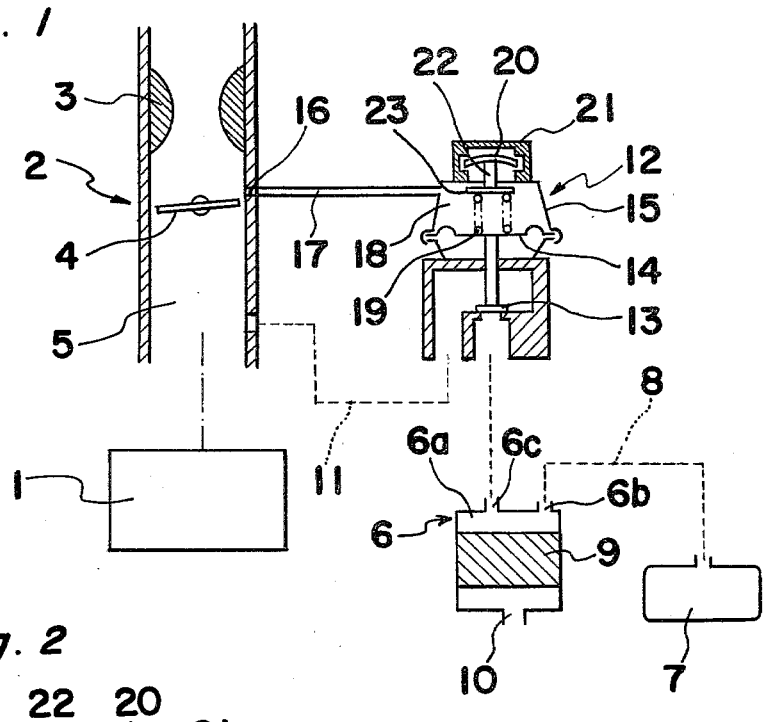
FIG. 1 is a schematic longitudinal sectional view of a temperature responsive, pressure operated diaphragm valve assembly as employed in an automobile evaporative emission control system.

Before the description of the present invention proceeds, it is to be noted that like parts are designated by like reference numerals throughout the accompanying drawings.

Referring first to the drawings, there is shown an automobile internal combustion engine 1 having one or more combustion chambers communicated to a source of air-fuel mixture through a fuel intake system 2 in any known manner. The fuel intake system 2 comprises an intake duct 5 having a venturi section 3 and a throttle valve 4 positioned downstream of the venturi section 3 with respect to the direction of flow of the air-fuel mixture towards the internal combustion chambers of the engine 1. Since the construction and operation of the engine 1 and its fuel intake system 2 are well known to those skilled in the art, a detailed description thereof is omitted for the sake of brevity.

Referring first to FIG. 1, there is shown a temperature responsive, pressure operated diaphragm valve assembly embodying the present invention as applied in a known automobile evaporative emission control system. The evaporative emission control system comprises a canister 6 having an introduction port **6*b* communicated to a fuel tank 7 through an introduction pipe 8, a supply port 6*c* and a vent port 10. The canister 6 has a bed 9 of purifying material such as any suitable filtering or adsorbent material installed within the interior of the canister 6 in such a manner as to leave a vacant space 6*a* between it and the wall of the canister 6 where the introduction and supply ports 6*b* and 6*c*** are defined.

The evaporative emission control system further comprises a supply passage 11 having one end fluid-connected to the supply port **6*a* and the other end communicated to the intake duct 5 and opening at a position downstream of the throttle valve 4, only a substantially intermediate portion of the supply passage 11** being shown in section for the purpose of the description of the present invention.

The temperature responsive, pressure operated diaphragm valve assembly employed in the evaporative emission control system is generally identified by 12 and comprises a housing 15 rigidly mounted on the supply passage 11 and having a diaphragm member 14 dividing the interior of the housing 15 into a working chamber 18 and an atmospheric chamber on respective sides of the diaphragm member 14, and a valving element 13 carried by the diaphragm member 14 for movement in a direction substantially perpendicular to the diaphragm member 14 between first and second positions for selectively closing and opening the supply passage 11, respectively. The working chamber 18 in the temperature responsive, pressure operated diaphragm valve assembly 12 is fluid-connected to the intake duct 5 through a sensing passage 17 having one end communicated to the working chamber 18 and the other end 16 communicated to the intake duct 5 and opening at a position upstream of the throttle valve 4 when the latter is held at an idle opening position, but downstream of the throttle valve 4 when the latter is held in a full open position. The diaphragm member 14 is normally biased by a coil spring 19, housed within the working chamber 18, in such a direction as to cause the valving element 13 to be held at the first position to close the supply passage 11 in a manner as best shown in FIG. 1.

The valve assembly 12 further comprises a temperature responsive control for adjusting the biasing force of the coil spring 19 according to the engine reference temperature detected thereby. By engine reference temperature is meant a temperature which is an indication of the operating condition of the engine, such as the engine compartment temperature or the cooling liquid temperature. This temperature responsive control comprises a temperature sensing element here shown in the form of a substantially elongated bimetallic plate 20 housed and stationarily held within a casing 21 rigidly mounted on the housing 15, and a connecting rod 22 having one end connected to the bimetallic plate 20 and the other end rigidly connected to a disc 23, said disc 23 being situated within the working chamber 18 and held in contact with the coil spring 19, a substantially intermediate portion of the connecting rod 22 extending axially displaceably through a portion of the wall of the housing 15 opposed to the diaphragm member 14.

Figure 2:
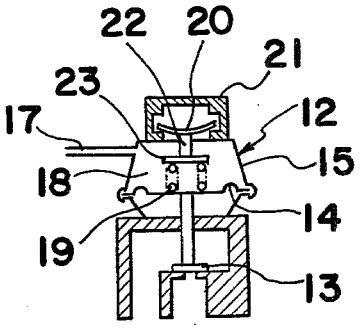
FIG. 2 is a view similar to FIG. 1, showing the valve assembly in a different operative position.

The bimetallic plate 20 is of such a type that, when the engine reference temperature sensed thereby is lower than a predetermined temperature, for example, 50° C., it will be deformed in one of to opposite directions, that is, convexed as shown in FIG. 1, and when the engine reference temperature sensed thereby is higher than the predetermined temperature, it will be deformed in the other of the opposite directions, that is, concaved as shown in FIG. 2. Accordingly, depending upon the engine reference temperature, that is, depending upon whether the bimetallic plate 20 is concaved as shown in FIG. 1 or whether the same is convexed as shown in FIG. 2, the biasing force or compressive force exerted by the coil spring 19 on the diaphragm member 14 varies. This means that the magnitude of negative pressure required to displace the diaphragm member 14 in such a direction as to bring the valving element 13 towards the second position to open the supply passage 11 in a controlled manner varies depending on the engine reference temperature which is sensed by the bimetallic plate 20 and which may be the temperature inside the automobile engine room or the temperature of a cooling water flowing in a jacket surrounding the engine 1. By way of example, in the illustrated embodiment, the temperature responsive control of the construction described above is so designed as to adjust the biasing or compressive force of the coil spring 19 acting on the diaphragm member 14 in the following manner.

(i) When and so long as the engine reference temperature is lower than the predetermined temperature, that is, 50° C., and, therefore, the bimetallic plate 20 is convexed as shown in FIG. 1, the coil spring 19 expands axially outwardly with its biasing force adjusted to such a value that a negative pressure higher than a predetermined negative pressure, for example, 100 mmHg, is required to be introduced into the working chamber 18 in order for the diaphragm member 14 to be displaced to bring the valving element 13 towards the second position.

(ii) When and so long as the engine reference temperature is higher than the predetermined temperature and, therefore, the bimetallic plate 20 is concaved as shown in FIG. 2, the coil spring 19 contracts axially inwardly with its biasing force adjusted to such a value higher than the maximum possible negative pressure which may be developed in the intake duct 5 and, hence, introduced into the working chamber 18, so that under this condition the supply passage 11 will never be opened regardless of the magnitude of the negative pressure.

In particular, under the condition (ii) above, the pressure operated diaphragm valve section of the temperature responsive, pressure operated diaphragm valve assembly 12 is brought into an inoperative position regardless of the magnitude of the negative pressure because the biasing force of the coil spring 19 so adjusted is higher than the maximum possible negative pressure which will be developed in the intake duct 5.

From the foregoing, it is clear that only when and so long as the engine reference temperature is lower than the predetermined temperature, the opening of the supply passage 11 governed by the position of the valving element 13 between the first and second positions is adjusted according to the magnitude of the negative pressure introduced into the working chamber 18 and, therefore, the rate of flow of fuel vapors from the fuel tank 7 towards the intake duct 5 through the supply passage 11 is controlled according to the opening of the supply passage 11. It is to be noted that, prior to the flow of the fuel vapors past the valving element 13, the fuel vapors supplied into the vacant space *6a* within the canister 6 are mixed with fresh air supplied thereinto through the vent port 10 by way of the purifying bed 9, this fresh air substantially regenerating the purifying bed 9.

On the other hand, when and so long as the engine reference temperature is higher than the predetermined temperature, the supply passage 11 is closed for the reason as hereinbefore described and, therefore, the fuel vapors from the fuel tank 7 are discharged to the atmosphere through the vent port 10 by way of the purifying bed 9. Since when the engine reference temperature is higher than the predetermined temperature it makes evaporation of fuel easier and since the mixing ratio of the air-fuel mixture can, therefore, be sufficiently controlled without the aid of the fuel vapors being additionally supplied into the intake duct 5, the interruption of the supply of the fuel vapors into the intake duct 5 through the supply passage 11 during the period when the engine reference temperature is higher than the predetermined temperature advantageously avoids any possible tendency of the once-controlled air-fuel mixture to become unnecessarily enriched.

It is to be noted that, although only the fuel tank 7 has been referred to as a source of the fuel vapors, the pipe 8 may be either fluid connected to a float chamber in any known carburetor instead of to the fuel tank or to both the fuel tank 7 and the float chamber in the carburetor. In addition, although the housing 15 has been described as divided into the two chambers by the diaphragm member 14, the housing 15 may have only the working chamber 15 and, in this case, the housing 15 should be rigidly mounted on and external of the supply passage 11 through any suitable spacer or spacers. Alternatively, in the illustrated embodiment, the atmospheric chamber on one side of the diaphragm member 14 opposite to the working chamber 18 may be utilized as a portion of the supply passage 11 as can readily be conceived from the temperature responsive, pressure operated diaphragm valve assembly employed in the subsequently described embodiments of the present invention.

Furthermore, although in the foregoing description the automobile evaporative emission control system has been described as brought into an inoperative position only when the engine reference temperature is higher than the predetermined value and, therefore, there is a tendency of the once-controlled air-fuel mixture flowing through the intake duct 5 to be enriched if additionally mixed with the fuel vapors, the temperature responsive, pressure operated diaphragm valve assembly of the present invention may be so designed that the automobile evaporative emission control system can be brought into the inoperative condition when the engine reference temperature is lower than the predetermined value such that a relatively large amount of fresh air introduced from the atmosphere by way of the vent port 10 and mixed with a limited amount of fuel vapors, which have been removed from the purifying bed 9 for regeneration of the latter, because of the less amount of the fuel vapors generated in the fuel tank as compared with that when the engine reference temperature is higher than the predetermined value, is supplied into the intake duct 5 through the supply passage 11, consequently making the once-controlled air-fuel mixture leaner to such an extent as to result in reduction in drivability of the automobile.

In the following embodiment shown in FIG. 3, the temperature responsive, pressure operated diaphragm valve assembly of the present invention is shown as applied in controlling the mode of operation of a temperature responsive switch assembly in accordance with the magnitude of the negative pressure developed in the intake duct 5 and controlled in the light of the engine reference temperature. More specifically, the temperature responsive, pressure operated diaphragm valve assembly of the present invention as applied in the manner described above and as will be described in detail later serves to adjust the timing at which the temperature responsive switch assembly is operated according to a combination of a reference temperature other than the temperature of the cooling water and the negative pressure developed in the intake duct 5.

Figure 3:
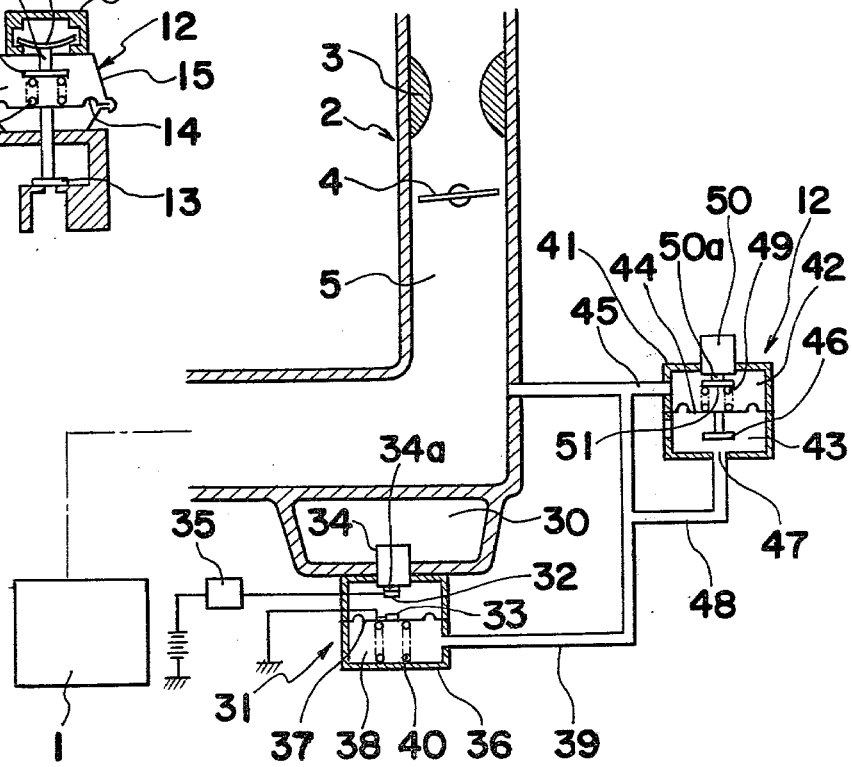
FIG. 3 is a schematic longitudinal sectional view of a temperature responsive, pressure operated diaphragm valve assembly as employed in controlling a switching valve assembly.

Referring now to FIG. 3, reference numeral 30 represents a cooling jacket through which a cooling water or any other suitable cooling liquid medium flows. In practice, the cooling water is, although used to forcibly cool the internal combustion engine 1, heated to a certain temperature by absorbing heat energies evolved in the engine 1 during the operation of the latter and, when it flows to a portion of the cooling jacket 30 adjacent and externally of the intake duct 5, the heated cooling water is utilized to heat the atmosphere inside the intake duct 5 to facilitate gasification of the air-fuel mixture flowing through the intake duct 5.

Reference numeral 31 represents a temperature responsive switch assembly having first and second movable switch contacts 32 and 33 adapted to be electrically connected to each other in a manner as will be described later when the temperature of the cooling water sensed by a temperature sensor 34 so positioned as to detect the temperature of the cooling water flowing externally of the intake duct 5 and downstream of the throttle valve 4 attains a value equal to or higher than a predetermined temperature. In practice, however, the time at which the first and second movable switch contacts 32 and 33 are electrically connected or short-circuited to each other varies for the reason which will become clear from the subsequent description.

The temperature sensor 34 forming a part of the temperature responsive switch assembly 31 may be of any known construction utilizing a thermowax, that is, a thermally expandable wax material, and having a push rod 34*a* capable of projecting and retracting relative to the body of the temperature sensor 34 according to expansion and contraction of the thermowax, respectively. For the purpose of the present invention, the thermowax used in the temperature sensor 34 is of a type capable of initiating its thermal expansion when the temperature of the cooling water flowing adjacent and externally of the intake duct 5 attains a predetermined value, for example, 55° C. It is to be noted the first movable switch contact 32 referred to above is rigidly secured to an outer end face of the push rod 34*a* in electrically insulated relation thereto and is in turn electrically connected to a controller 35 and then to the ground through a source of electrical power, for example, a DC battery source.

The temperature responsive switch assembly 31 comprises a housing 36 and a diaphragm member 37 dividing the interior of the housing 36 into an atmospheric chamber and a working chamber 38 on respective sides of said diaphragm member 37, said working chamber 38 being communicated through a passage 39 to a portion of the intake duct 5 downstream of the throttle valve 4. Housed within the housing 36 and interposed between the diaphragm member 37 and a portion of the wall of the housing 36 facing the working chamber 38 in opposition to the diaphragm member 37 is a biasing spring 40 used to cause the diaphragm member 37 to assume a neutral position. It is to be noted that the second movable switch contact 33 referred to above is rigidly mounted on one of the surfaces of the diaphragm member 37 facing the atmospheric chamber in opposition to the first movable switch contact 32 and is electrically connected to the ground.

The temperature responsive, pressure operated diaphragm valve assembly 12 used in the embodiment shown in FIG. 3 comprises a housing 41 having its interior divided into a working chamber 42 and an atmospheric chamber 43 by a diaphragm member 44, said working chamber 42 being communicated through a passage 45 to a portion of the passage 39 adjacent the intake duct 5. The valve assembly 12 also comprises a valving element 46 rigidly carried by the diaphragm member 44 and situated within the atmospheric chamber 43, said valving element 46 being adapted to selectively open and close a port 47 which is defined in the wall of the housing 41 in communication with the atmospheric chamber 43 and which is in turn communicated through a passage 48 to another portion of the passage 39 adjacent the temperature responsive switch assembly 31.

The temperature responsive control for adjusting the biasing force of a coil spring 49 according to the reference temperature detected thereby, which control forms a part of the valve assembly 12, comprises a temperature sensor 50 similar or identical in construction and function to the temperature sensor 34 forming a part of the temperature responsive switch assembly 31, said temperature sensor 50 having a push rod 50*a* held in contact with the coil spring 49 through a disc 51 fast with said push rod 50*a*. However, it is to be noted that the reference temperature sensed by the temperature sensor 50 must be other than the temperature of the engine cooling water, for example, the temperature in the open air.

The valve assembly 12 so far employed in the embodiment shown in FIG. 3 is operable in such a manner that, when the temperature in the open air increases to a value higher than the predetermined temperature at which the thermowax in the temperature sensor 50 starts its thermal expansion, the axially outward biasing force of the coil spring 49 acting on the diaphragm member 44 correspondingly increases to such an extent that, for a given negative pressure introduced into the working chamber 42, the opening of the port 47 is adjusted to a smaller value than that when the temperature in the open air is lower than the predetermined temperature. The smaller the opening of the port 47 is, the larger the amount of air inside the working chamber 38 is drawn into the intake duct 5, and conversely, the larger the opening of the port 47 is, the smaller the amount of air inside the working chamber 38 is drawn into the intake duct 5.

Accordingly, the position of the second movable switch contact 33 relative to the first movable switch contact 32 is determined by the combination of the negative pressure inside the intake duct 5 and the temperature in the open air while the position of the first movable switch contact 32 relative to the second movable switch contact 33 is determined by the temperature of the cooling water flowing through that portion of the jacket 30. In view of this, the first and second movable switch contacts 32 and 33 are engaged with each other only when the temperature in the open air is relatively high and, at the same time, the push rod 34*a* is moved a relatively large distance in a direction towards the diaphragm member 57. In other words, the time at which the temperature responsive switch assembly 31 is operated is determined by the combination of the temperature of the cooling water, the temperature in the open air and the negative pressure inside the intake conduit 5.

The temperature responsive, pressure operated valve assembly according to the present invention can also be applied in any known exhaust gas recirculating system (EGR system) for controlling the rate of flow of exhaust gases from an exhaust system of the engine to the fuel intake system of the same engine according to the engine reference temperature, for example, either the temperature of the cooling water or the temperature inside the automobile engine compartment, an example of which will now be described with particular reference to FIGS. 4 to 7.

Figure 4:
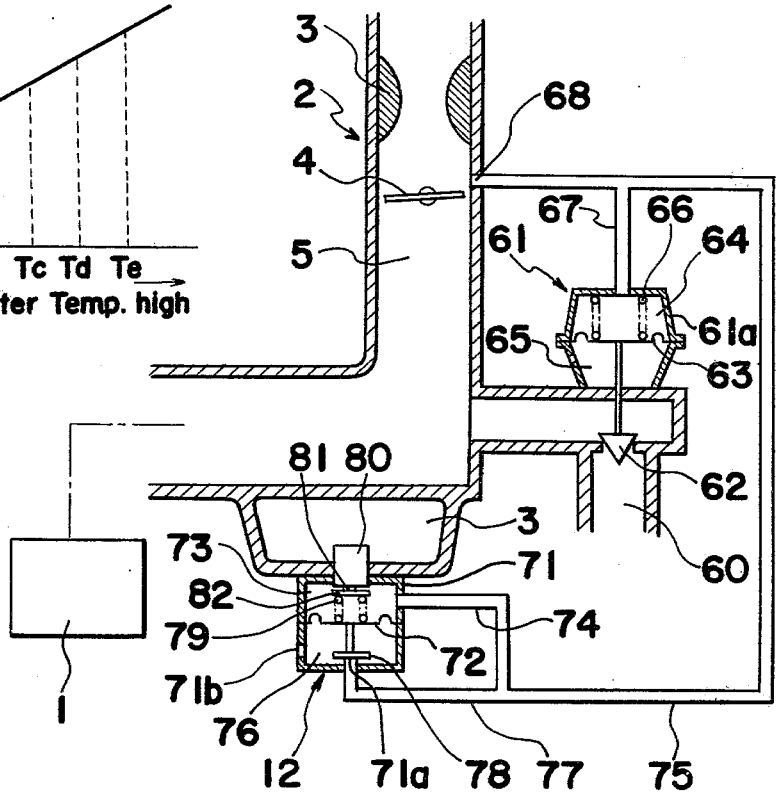
FIG. 4 is a schematic longitudinal sectional view of a temperature responsive, pressure operated diaphragm valve assembly as employed in an EGR system.

Referring first to FIG. 4, the EGR system is shown as comprising a recirculating passage 60 having one end communicated to an exhaust manifold (not shown) leading from the combustion chambers of the engine 1 to the atmosphere, and the other end communicated to a portion of the intake duct 5 downstream of the throttle valve 4. The EGR system also comprises a diaphragm valve assembly 61 having a valving element 62 adapted to selectively open and close the recirculating passage 60. This diaphragm valve assembly 61 is constituted by a housing 61*a* and a diaphragm member 63 dividing the interior of the housing 61*a* into a working chamber 64 and an atmospheric chamber 65 on respective sides of said diaphragm member 63, said working chamber 64 being fluid connected to the intake duct 5 through a passage 67 which has one end communicated to the working chamber 64 and the other end 68 opening into the intake duct 5 at a position downstream of the throttle valve 4 when the latter is held in the full open position, but upstream of the throttle valve 4 when the latter is held at the idle opening position. The valve assembly 61 also includes a biasing spring 66 housed within the working chamber 64 and adapted to bias the diaphragm member 63 in such a direction as to cause the valving element 62 to close the recirculating passage 60 as shown.

In the construction so far described, it is clear that, when the negative pressure introduced into the working chamber 64 is higher than the biasing force of the spring 66, the diaphragm member 63 is displaced in such a direction as to cause the valving element 62 to open the recirculating passage 60, the opening of the recirculating passage 60 being determined according to the magnitude of the negative pressure inside the intake duct 5. Preferably, the diaphragm valve assembly 61 is so designed that, when the negative pressure developed inside the intake duct 5 and adjacent the open end 68 of the passage 67 attains a predetermined value, for example, 100 mmHg, the valving element 62 starts opening the recirculating passage 60 and, when the same negative pressure attains a value equal to or higher than 150 mmHg, the recirculating passage 60 is fully opened.

The temperature responsive, pressure operated diaphragm valve assembly 12 employed in the embodiment shown in FIG. 4 is similar in construction to the temperature responsive pressure operated diaphragm valve assembly employed in the embodiment shown in FIG. 3, but is positioned in a manner similar to the temperature responsive switch assembly 31 employed in the embodiment shown in FIG. 3. Specifically, the valve assembly 12 in the embodiment shown in FIG. 4 comprises a housing 71, the interior of which is divided by a diaphragm member 72 into a working chamber 73, communicated to the passage 67 through a branch passage 74 and then through a passage 75, and an atmospheric chamber 76 communicated to the passage 75 through a branch passage 77, a valving element 78 adapted to selectively open and close the opening 71*a* which is defined in the wall of the housing 71 and communicated to the branch passage 77, and a biasing spring 79 biasing the diaphragm member 72 in such a direction as to cause the valving element 78 to close the opening 71*a*. It is to be noted that the atmospheric chamber 76 is vented to the atmosphere through a vent port 71*b* defined in the wall of the housing 71 and, accordingly, the valving element 78 serves to selectively establish and interrupt the communication between the branch passage 77 and the atmosphere by way of the atmospheric chamber 76.

The valve assembly 12 further comprises a temperature sensor 80 of a construction identical with that of the valve assembly 12 in the embodiment of FIG. 3 and including a push rod 81 and a disc 82 positioned between an outer end of the push rod 81 and the biasing spring 79. The thermowax employed in the temperature sensor 80 is preferably of a type capable of starting its thermal expansion when the temperature of the cooling water flowing through that portion of the jacket 31 attains a predetermined temperature shown by Ta in FIG. 5, for example, 10° C. The graph of FIG. 5 illustrates a curve showing the manner of increase of the volume of the thermowax, used in the temperature sensor 80, relative to an increase of the temperature.

Figure 5:
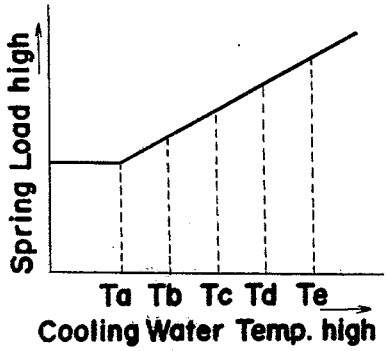
FIG. 5 is a graph showing the rate of increase of the biasing force of a biasing spring used to urge the diaphragm member relative to increase of the engine reference temperature.

The valve assembly 12 employed in the embodiment shown in FIG. 4 is so designed that, before the temperature of the cooling water sensed by the temperature sensor 80 attains the predetermined temperature Ta, the biasing spring 79 exerts a minimum biasing force on the diaphragm member 72, said minimum biasing force being of a value corresponding to the force of the negative pressure of, for example, 80 mmHg, lower than the negative pressure of, for example, 100 mmHg, required to displace the diaphragm member 63 of the valve assembly 61 against the spring 66 so as to initiate the opening of the recirculating passage 60, and that when the temperature of the same cooling water subsequently increases to a value shown by Te in FIG. 5 and higher than any one of the temperatures Ta, Tb, Tc and Td, the same biasing spring 79 exerts a maximum biasing force on the diaphragm member 72, said maximum biasing force being of a value corresponding to the force of the negative pressure of, for example, 200 mmHg, higher than the negative pressure of, for example, 150 mmHg, required to completely displace the diaphragm member 63 of the valve assembly 61 against the spring 66 so as to bring the recirculating passage 60 into a full open position.

The EGR system to which the present invention is applied in the manner shown in and described with particular reference to FIG. 4 operates in the following manner.

When the temperature of the cooling water sensed by the temperature sensor 80 is lower than the predetermined temperature Ta and, at the same time, the throttle valve 4 is adjusted from a substantially closed position towards a full open position and to such an extent that the negative pressure higher than 80 mmHg is developed in the vicinity of the open end 68 of the passage 67 and, therefore, introduced into the working chamber 64 of the diaphragm valve assembly 61, the same negative pressure is also introduced through the passage 75 into both the working chamber 73 and the branch passage 77 and, accordingly, the valving element 78 opens the opening 71*a*. Upon opening the opening 71*a* in the manner described above, fresh air is introduced from the atmosphere into the branch passage 77 and then into the working chamber 73 through the branch passage 74 thereby reducing the negative pressure inside the working chamber 73 to about 80 mmHg. At the same time, the fresh air so introduced into the branch passage 77 is also introduced into the working chamber 64 of the valve assembly 61 through the passage 75 and, therefore, the negative pressure inside the working chamber 64 is equalized to 80 mmHg which is lower than the negative pressure of 100 mmHg required to displace the diaphragm member 63 against the spring 66 to cause the valving element 62 to open the recirculating passage 60. Thus, under this condition, the valve assembly 61 is inoperative with the valving element 62 closing the recirculating passage 60, thereby avoiding the recirculation of the exhaust gases into the intake duct 5 prior to the warm-up of the engine 1 which would otherwise result in reduction in drivability of the automobile.

When the temperature of the cooling water sensed by the temperature sensor 80 subsequently increases to a value higher than the predetermined temperature at which the thermowas in the temperature sensor 80 starts its thermal expansion, the biasing force of the biasing spring 79 correspondingly increases so that the maximum negative pressure introduced into the working chamber 73 of the valve assembly 12 and, therefore, the working chamber 64 of the valve assembly 61 for the particular temperature of the cooling water can be determined.

In particular, when the temperature of the cooling water sensed by the temperature sensor 80 becomes higher than the temperature Te as shown in the graph of FIG. 5, the biasing spring 79 is axially inwardly compressed to such an extent as to exert the biasing force corresponding to the negative pressure of 200 mmHg. Under this condition, when the opening of the throttle valve 4 is further adjusted according to the magnitude of the load imposed on the engine 1 to such an extent that the negative pressure of a value intermediately between 100 mmHg and 150 mmHg is developed in the vicinity of the open end 68 of the passage 67, the opening of the recirculating passage 60 is controlled in accordance with the negative pressure introduced into the working chamber 64 of the valve assembly 61 in a manner as shown by a curve E in the graph of FIG. 6.

Figure 6:
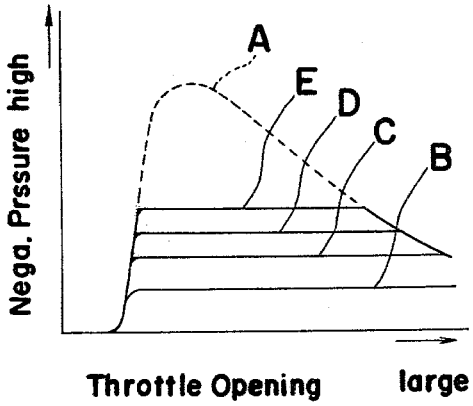
FIG. 6 is a graph showing the performance characteristic of the temperature responsive, pressure operated diaphragm valve assembly as used in the EGR system.
Figure 7:
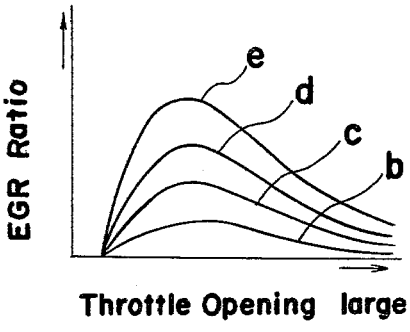
FIG. 7 is a graph similar to FIG. 6, showing the relationship between the EGR ratio and the opening of the throttle valve.

Referring to the graph of FIG. 6, a curve A represents variation of the negative pressure inside the intake duct 5 and in the vicinity of the open end 68 of the passage 67 relative to the opening of the throttle valve 4. However, the distance between the peak value of each of the curves B, C, D and E and the base line (the axis of abscissa) represents the maximum displacement of the diaphragm member 63 in a direction against the spring 66 which is attained when the temperature of the cooling water sensed by the temperature sensor 80 is of a respective value Tb, Tc, Td or Te. In other words, as the temperature of the cooling water sensed by the temperature sensor 80 increases from the value Ta to the value Te past the intermediate values Tb, Tc and Td as shown in the graph of FIG. 5, the biasing force of the biasing spring 79 increases and, in correspondence with the increase of the biasing force of the biasing spring 79, the maximum value of the negative pressure introduced into the working chamber 64 of the valve assembly 61 is increased. While the curves B, C, D and E in the graph shown in FIG. 6 depict the maximum displacement of the diaphragm member 63 against the biasing spring 66 which is attained when the temperature of the cooling water sensed by the temperature sensor 80 is Tb, Tc, Td and Te, the curves b, c, d and e in the graph of FIG. 7 represent the EGR ratio when the temperature of the cooling water sensed by the temperature sensor 80 is Tb, Tc, Td and Te, respectively.

The type of EGR system to which the present invention is applicable is not limited to that described with particular reference to and shown in FIG. 4, but may be of any known construction. In addition, the temperature responsive, pressure operated diaphragm valve assembly of the present invention can also be utilized as one controlled by the negative pressure occurring in the engine intake system, such as one for a negative pressure operated, ignition control device.

From the foregoing full description of the present invention, it is clear that, since the diaphragm valve assembly is provided with means for adjusting the biasing force of the spring housed within the working chamber and acting on the diaphragm member, substantially no careful management of the sealability of a valving element such as required in the prior art valve assembly is required.

Although the present invention has fully been described in connection with the preferred embodiments thereof with reference to the accompanying drawings, it is to be noted that various changes and modifications will be apparent to those skilled in the art. Such changes and modifications are to be understood as being included within the true scope of the present invention unless they depart therefrom.

I claim:

1. A temperature responsive, pressure operated diaphragm valve assembly for use in association with an automobile internal combustion engine having an intake duct leading to at least one combustion chamber, said intake duct having a throttle valve disposed therein for pivotal movement between a substantially closed position and a full open position, and an exhaust manifold leading from the combustion chamber towards the atmosphere, said temperature responsive, pressure operated diaphragm valve assembly comprising, in combination:

a first valve actuator housing;

a first diaphragm member housed within the first valve actuator housing and dividing the interior of the first valve actuator housing into a first chamber, and a second chamber communicated to the atmosphere;

a first passage means between said first chamber and a portion of the intake duct;

a first biasing spring housed within the first chamber and exerting a biasing force on the first diaphragm member to displace the latter in one direction;

a first valving element carried by the first diaphragm member and positioned on one side of the first diaphragm member opposite to the first biasing spring, second passage means having one end communicated to the intake duct and the other end communicated to a source of fluid medium, said first valving element being movable by said first diaphragm member for selectively opening and closing said second passage means when and so long as the first diaphragm member is displaced in said one direction and opening said second passage when the first diaphragm member is displaced in the other direction opposite to said one direction; and means operable in response to change in an engine reference temperature for adjusting the biasing force of the first biasing spring according to a change in the engine reference temperature and including a first temperature sensing element having a parameter, the magnitude of said parameter being variable as a function of the engine reference temperature, and a first push rod supported for axial movement between projected and retracted positions and having one end connected to the first biasing spring and the other end operatively associated with the first temperature sensing element for, as the temperature sensed by the first temperature sensor increases, moving said first push rod from the retracted position towards the projected position adjusting the first biasing spring to change the biasing force thereof.

2. A valve assembly as claimed in claim 1 in which said other end of said second passage means is communicated to said second chamber, the atmosphere in said second chamber constituting said source of fluid medium.

3. A valve assembly as claimed in claim 1, wherein said one end of the second passage is communicated to the intake duct by way of the first passage and said fluid source is constituted by the atmosphere, and further comprising an exhaust gas recirculating system including a recirculating passage having one end communicated to a portion of the intake duct and the other end communicated to the exhaust passage, and a diaphragm control valve assembly including a further valve actuator housing and dividing the interior of the further valve actuator housing into a working chamber and an atmospheric chamber a third passage having one end communicated to the working chamber and the other end fluid connected to the first passage, a further biasing spring housed within the working chamber and exerting a biasing force on the further diaphragm member, and a further valving element rigidly carried by the further diaphragm member for displacement together with the further diaphragm member, said further valving element being adapted to selectively open and close the recirculating passage, said further valving element closing the recirculating passage when the further diaphragm member is biased in one direction by the further biasing spring, but opening the recirculating passage when the negative pressure sufficient to overcome the biasing force of the further biasing spring is introduced into the working chamber.

4. A valve assembly as claimed in claim 3, wherein the first temperature sensor is supported in position to detect the temperature of a cooling water used to cool the engine.

5. A valve assembly as claimed in claim 3, wherein said first temperature sensing element is a thermally expandable wax material and said parameter is the rate of thermal expansion of the wax material.

6. A valve assembly as claimed in claim 3, wherein one end of the first passage adjacent the intake duct opens into the intake duct at a position upstream of the throttle valve when the latter is held at an idle opening position, but downstream of the throttle valve when the latter is held in the full open position.

7. A valve assembly as claimed in claim 5, wherein the second passage extends between the atmosphere and the first passage by way of the second chamber.

* * * * *